US009586261B2

(12) United States Patent
Aida et al.

(10) Patent No.: US 9,586,261 B2
(45) Date of Patent: Mar. 7, 2017

(54) APPARATUS FOR PRODUCING SEMI-SOLIDIFIED METAL, METHOD FOR PRODUCING SEMI-SOLIDIFIED METAL, AND SEMI-SOLIDIFIED METAL

(71) Applicant: Toshiba Kikai Kabushiki Kaisha, Tokyo (JP)

(72) Inventors: Satoru Aida, Tokyo (JP); Satoshi Tomioka, Zama (JP); Koei Nakata, Zama (JP)

(73) Assignee: TOSHIBA KIKAI KABUSHIKI KAISHA, Tokyo (JP)

( * ) Notice: Subject to any disclaimer, the term of this patent is extended or adjusted under 35 U.S.C. 154(b) by 705 days.

(21) Appl. No.: 13/916,239

(22) Filed: Jun. 12, 2013

(65) Prior Publication Data

US 2013/0330228 A1 Dec. 12, 2013

(30) Foreign Application Priority Data

Jun. 12, 2012 (JP) ..... 2012-132824
Jun. 12, 2012 (JP) ..... 2012-132825
Apr. 24, 2013 (JP) ..... 2013-091307

(51) Int. Cl.
*B22D 41/01* (2006.01)
*B22D 47/00* (2006.01)

(52) U.S. Cl.
CPC ..... *B22D 41/01* (2013.01); *B22D 47/00* (2013.01)

(58) Field of Classification Search
CPC ..... B22D 41/05; B22D 41/005
USPC ..... 266/236
See application file for complete search history.

(56) References Cited

U.S. PATENT DOCUMENTS 6,681,836 B1 * 1/2004 Sakamoto ..... B22D 1/00 164/133
2010/0024927 A1 2/2010 Shikai et al.
2013/0330228 A1 * 12/2013 Aida ..... B22D 47/00 420/591

(Continued)

FOREIGN PATENT DOCUMENTS

CN 101367123 2/2009
CN 101786156 7/2010

(Continued)

OTHER PUBLICATIONS

English Language Abstract for CN 101367123 published Feb. 18, 2009.

(Continued)

*Primary Examiner* — Scott Kastler
(74) *Attorney, Agent, or Firm* — DLA Piper LLP US

(57) ABSTRACT

An apparatus for producing a semi-solidified metal has a heating device which heats a metal material, a vessel, a cooling device which cools the vessel, and a pouring device which pours the metal material into the vessel. The vessel has a hollow member which configures a wall of the vessel and is opened at both of the upper and lower ends and into which the metal material is poured from the upper opening, and a bottom member which closes the lower opening of the hollow member and configures the bottom of the vessel. The cooling speed of the metal material by the bottom member is faster than the cooling speed of the metal material by the hollow member.

19 Claims, 2 Drawing Sheets

(56) References Cited

U.S. PATENT DOCUMENTS

2015/0101775 A1* 4/2015 Nakata ..... B22D 17/10
164/113

FOREIGN PATENT DOCUMENTS

| | | |
|---|---|---|
| JP | 62-161463 | 7/1987 |
| JP | S64-002777 | 1/1989 |
| JP | 08-243707 | 9/1996 |
| JP | 2000-343200 | 12/2000 |
| JP | 2003-505251 | 2/2003 |
| JP | 2007-181874 | 7/2007 |
| JP | 2008-511443 | 4/2008 |
| KR | 20-2012-0000118 | 11/2012 |
| WO | WO 2005/110644 | 11/2005 |
| WO | WO 2006/024148 | 3/2006 |
| WO | WO 2008/096411 | 8/2008 |

OTHER PUBLICATIONS

English Language Abstract for CN 101786156 published Jul. 28, 2010.
English Language Abstract for KR-20-2012-0000118 published Nov. 7, 2012.
English Language Abstract for JP S64-002777 published Jan. 6, 1989.
English Language Abstract and Translation of JP 2007-181874 published on Jul. 19, 2007.
English Language Translation of JP 2003-505251 published on Feb. 12, 2003.
English Language Translation of JP 2008-511443 published on Apr. 17, 2008.
English Language Abstract and Translation of JP 2000-343200 Published on Dec. 12, 2000.
English Language Abstract of JP 62-161463 published Jul. 17, 1987.
English Language Abstract and Translation of JP H08-243707 published Sep. 24, 1996.

* cited by examiner

APPARATUS FOR PRODUCING SEMI-SOLIDIFIED METAL, METHOD FOR PRODUCING SEMI-SOLIDIFIED METAL, AND SEMI-SOLIDIFIED METAL

TECHNICAL FIELD

The present invention relates to an apparatus for producing a semi-solidified metal, a method for producing a semi-solidified metal, and a semi-solidified metal. The semi-solidified metal is utilized in for example the semi-solid die casting method.

BACKGROUND ART

As the method for producing a semi-solidified metal, there is known a method of pouring a metal material which has been heated to a liquid into a vessel which has been cooled in advance and thereby cool the metal material and make the metal material a semi-solidified state (Patent Literature 1 and 2).

In the arts of Patent Literature 1 and 2, a relatively small hole is formed at the center of the bottom in the vessel. The liquid-state metal material is poured into the vessel in a state where that hole is closed. Further, when the metal material in the vessel becomes the semi-solidified state, the hole is opened and a portion of the liquid phase part contained in the semi-solidified metal is discharged through the hole. Patent Literature 1 and 2 consider that the solid phase rate can be raised without changing the temperature by such discharge of a portion of the liquid phase part.

CITATIONS LIST

Patent Literature 1: Japanese Patent Publication No. 2003-505251A

Patent Literature 2: Japanese Patent Publication No. 2008-511443A

Patent Literature 3: WO2005/110644

SUMMARY OF INVENTION

Technical Problem

In the arts of Patent Literature 1 and 2, a portion of the liquid phase part is discharged from the vessel, therefore various inconveniences arise. For example, when the liquid phase part is discharged, cavities are formed in the semi-solidified metal, therefore gas (for example air) invades the cavities, so the product quality is degraded. Further, it is difficult to predict what extent of amount the liquid phase part will be discharged, therefore the casting weight cannot be correctly controlled.

On the other hand, the solid phase rate can be controlled by suitably controlling the temperature of the metal material (Patent Literature 3), so the discharge of a portion of the liquid phase part from the vessel is not an indispensable process.

However, if not discharging a portion of the liquid phase part from the vessel, it is considered that in the process of taking out the semi-solidified metal from the vessel to feed it to an injection apparatus, the liquid phase part will end up dripping from the semi-solidified metal or other inconveniences will occur. In particular, the solid phase rate tends to become low at a position away from the wall section of the vessel (center of the vessel), therefore the liquid phase part is liable to drip from the center of the bottom portion of the semi-solidified metal. That is, since the solid phase rate is not suitably controlled at a portion of the semi-solidified metal, the handling property of the semi-solidified metal falls in a case when not discharging a portion of the liquid phase part.

Accordingly, desirably, there are provided a production apparatus and production method of semi-solidified metal capable of suitably controlling the solid phase rate. Further, desirably, there is provided semi-solidified metal having a suitably controlled solid phase rate.

Solution to Problem

An apparatus for producing a semi-solidified metal according to a first aspect of the present invention has a heating device which heats a metal material; a vessel; a cooling device which cools the vessel; and a pouring device which pours the heated metal material into the cooled vessel. The vessel has a hollow member which configures a wall of the vessel and is opened at both of the upper and lower ends and into which the metal material is poured from the upper opening, and has a bottom member which closes the lower opening of the hollow member and configures the bottom of the vessel. The cooling speed of the metal material by the bottom member is faster than the cooling speed of the metal material by the hollow member.

An apparatus for producing a semi-solidified metal according to a second aspect of the present invention has a heating device which heats a metal material, a vessel, a cooling device which cools the vessel, and a pouring device which pours heated metal material into the cooled vessel. A hole which has a diameter by which part of the liquid phase contained in the metal material cannot flow to the outside of the vessel and gas in the vessel can flow to the outside of the vessel is formed at the lower side of the vessel.

A method for producing a semi-solidified metal according to a third aspect of the present invention has a step of pouring a metal material in a state where its temperature is higher than a liquidus temperature of the metal material into a vessel having a temperature lower than the liquidus temperature to make the temperature of the metal material reach a temperature between the solidus temperature of the metal material and the liquidus temperature and thereby render the metal material a semi-solidified state. The vessel has a hollow member which configures a wall of the vessel and is opened at both of the upper and lower ends and into which the metal material is poured from the upper opening, and has a bottom member which closes the lower opening of the hollow member and configures the bottom of the vessel. The cooling speed of the metal material by the bottom member is faster than the cooling speed of the metal material by the hollow member.

A method for producing a semi-solidified metal according to a fourth aspect of the present invention has a step of pouring a metal material in a state where its temperature is higher than a liquidus temperature of the metal material into a vessel having a temperature lower than the liquidus temperature to make the temperature of the metal material reach a temperature between the solidus temperature of the metal material and the liquidus temperature and thereby render the metal material a semi-solidified state. In the metal material, the cooling speed of the part which contacts the bottom of the vessel is made faster than the cooling speed of the part which contacts the wall of the vessel.

A method for producing a semi-solidified metal according to a fifth aspect of the present invention has a step of pouring a metal material in a state where its temperature is higher than a liquidus temperature of the metal material into a vessel, to make the temperature of the metal material reach a temperature between the solidus temperature of the metal material and the liquidus temperature in the vessel and thereby render the metal material a semi-solidified state. A hole which has a diameter by which part of the liquid phase contained in the metal material cannot flow to the outside of the vessel is formed at the vessel. Gas in the vessel is made to flow out from the hole to the outside of the vessel when pouring the metal material into the vessel.

A semi-solidified metal according to a sixth aspect of the present invention is a semi-solidified metal which is changed from a liquid state to a semi-solidified state in a vessel, wherein the lower portion of the semi-solidified metal has a higher solid phase rate than the upper portion of the semi-solidified metal.

Advantageous Effects of Invention

According to the present invention, the solid phase rate can be suitably controlled.

BRIEF DESCRIPTION OF DRAWINGS

FIG. 2A is a perspective view which shows a vessel of the apparatus for producing a semi-solidified metal in FIG. 1, while

DESCRIPTION OF EMBODIMENTS

First Embodiment

Configuration of Production Apparatus

Figure 1:
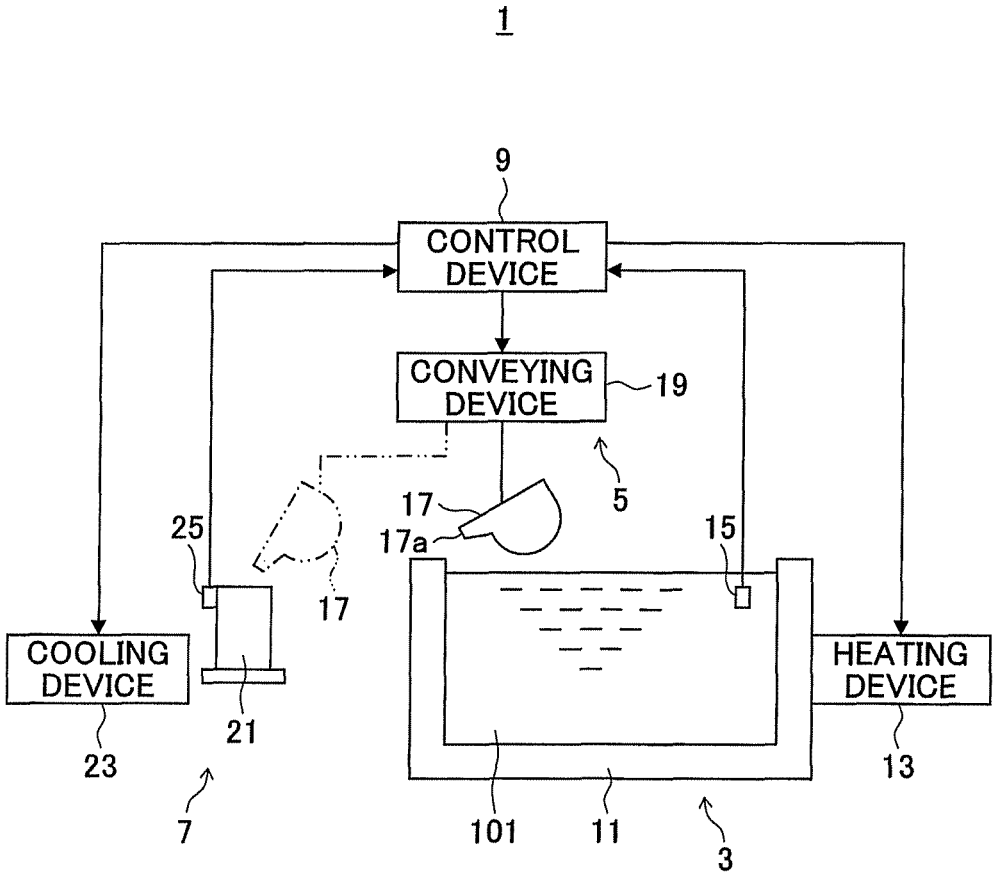
FIG. 1 A schematic view which show the configuration of principal parts of an apparatus for producing a semi-solidified metal according to an embodiment of the present invention.

FIG. 1 is a schematic view which shows the configuration of principal parts of a production apparatus 1 of a semi-solidified metal according to a first embodiment of the present invention.

The production apparatus 1 has for example a holding furnace 3 for holding a liquid-state metal material 101, a pouring device 5 for dipping out the liquid-state metal material from the holding furnace 3, a semi-solidification device 7 into which the liquid-state metal material is poured by the pouring device 5 and which renders the poured liquid-state metal material a semi-solidified state, and a control device 9 for controlling these devices. The metal material 101 is for example an aluminum alloy.

The holding furnace 3 may be given a known configuration. Further, the holding furnace 3 may act also as a melting furnace. For example, the holding furnace 3 has a furnace body 11 which holds the metal material 101, a heating device 13 which heats the metal material 101 which held in the furnace body 11, and a first temperature sensor 15 which detects the temperature of the metal material 101 which is held in the furnace body 11.

The furnace body 11 is, for example, although not particularly shown, configured by a vessel which is made of a ceramic or another material excellent in thermal insulation in which a vessel which is made of a metal having a higher solidus temperature or melting point than the liquidus temperature of the metal material 101 is arranged. The heating device 13 is configured by including for example a coil which heats the metal material 101 by electromagnetic induction or a combustion device which burns gas to heat the metal material 101. The first temperature sensor 15 is configured by for example a thermocouple type temperature sensor or radiant thermometer.

The pouring device 5 may be given a known configuration. For example, the pouring device 5 has a ladle 17 and a conveying device 19 which is capable of driving the ladle 17.

The ladle 17 is a vessel which is made of a material having a higher solidus temperature or melting point than the liquidus temperature of the metal material 101 and which has a pouring port 17*a*. It can hold one shot's worth of the metal material 101. The conveying device 19 is configured by for example an articulated robot, can move the ladle 17 in an up/down direction and horizontal direction, and can incline the ladle 17 so as to move the pouring port 17*a* up and down.

The semi-solidification device 7 has a vessel 21 into which the metal material 101 is poured by the pouring device 5, a cooling device 23 which cools the vessel 21, and a second temperature sensor 25 which detects the temperature of the vessel 21.

The vessel 21 is configured by a material (preferably a metal) which has a higher solidus temperature or melting point than the liquidus temperature of the metal material 101 and preferably has a relatively high thermal conductivity. The vessel 21 can hold one shot's worth of the metal material 101.

The cooling device 23 and the second temperature sensor 25 may be given known configurations. For example, the cooling device 23 includes, although not particularly shown, a flow channel for running a coolant around the vessel 21, a heat exchanger which cools the coolant, and a pump which sends out the coolant. Note that, preferably, the cooling device 23 can cool both of the wall and bottom of the vessel 21. For example, the channel through which the coolant runs extends so as to be adjacent to both of the wall and the bottom. The second temperature sensor 25 is configured by for example a resistance type temperature sensor.

The control device 9 is configured by for example a computer which includes a CPU, ROM, RAM, external memory device, etc. The control device 9 receives as input detection values of the first temperature sensor 15, the second temperature sensor 25, a not shown encoder of the conveying device 19, and so on. Further, the control device 9 outputs control signals to the heating device 13, a not shown motor of the conveying device 19, and the cooling device 23 (for example pump which sends out the coolant).

Figure 2A:
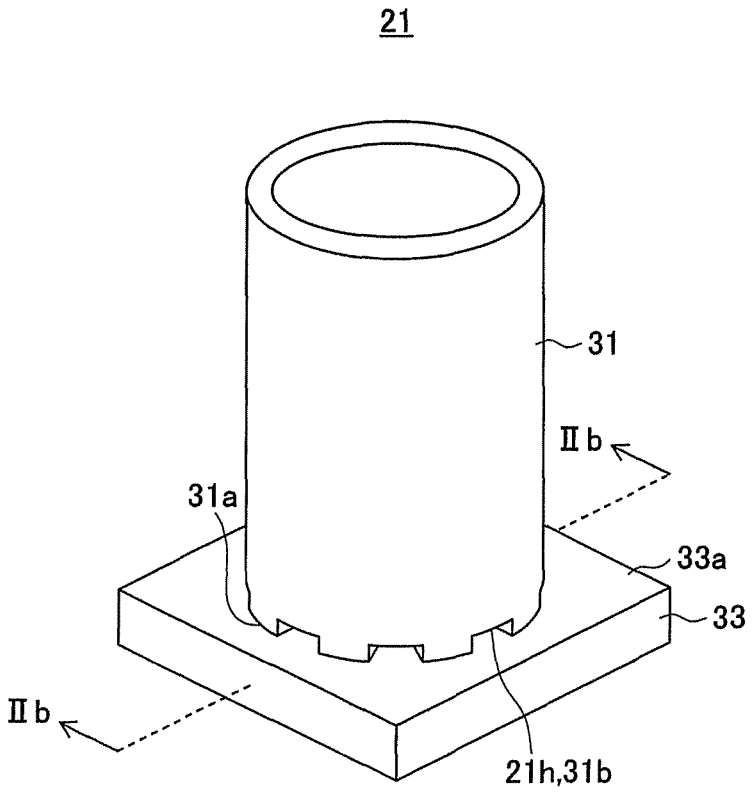
Figure 2B:
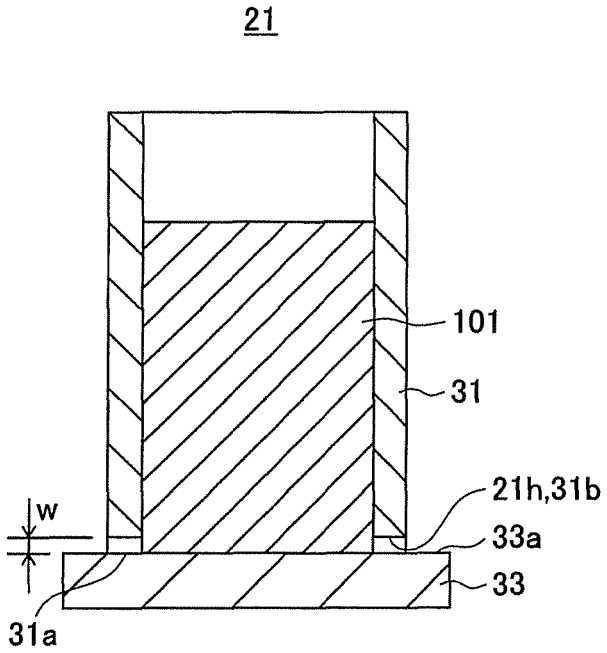
FIG. 2B is a cross-sectional view taken along a line IIb-IIb in FIG. 2A.

FIG. 2A is a perspective view which shows the vessel 21, while FIG. 2B is a cross-sectional view taken along a line IIb-IIb in FIG. 2A.

The vessel 21 has a hollow member 31 which configures the wall of the vessel 21 and a bottom member 23 which configures the bottom of the vessel 21.

The hollow member 31 is formed in for example a hollow shape which have openings at both of the upper and lower ends. The shape of the hollow member 31 seen in the opening direction may be suitably set. However, from the viewpoint of equally cooling the metal material 101, it is preferably a circle (the hollow member 31 is preferably tubular). Further, the inner diameter and outer shape of the hollow member 31 are made for example constant in the up/down direction, and the thickness is made constant as well. Note, the inner diameter may be made larger toward the upper part or lower part, and the thickness may be made larger toward the upper part or lower part.

The bottom member 33 is for example a roughly plate-shaped member. The planar shape of the bottom member 33 may be suitably set. A rectangle is illustrated in the present embodiment. The outer shape of the bottom member 33 when seen by a plan view is set broader than the opening of the hollow member 31. The thickness of the bottom member 33 is for example made constant. Note, the thickness may differ between the center side and the outer periphery side. Further, an upper surface 33*a* of the bottom member 33 may be provided with an inclination. For example the height may differ between the center side and the outer periphery side.

Further, the vessel 21 is configured with the hollow member 31 placed on the upper surface 33*a* of the bottom member 33 and with the lower opening of the hollow member 31 closed by the bottom member 33. Note that, although not particularly shown, the hollow member 31 and the bottom member 33 are held by a clamping mechanism, fixture, or other suitable fastening device so that they cannot move relative to each other. The hollow member 31 and the bottom member 33 need not use the fastening device. The hollow member 31 may also be only placed on the bottom member 33 which is placed horizontally. Further, positioning portions for positioning the hollow member 31 and the bottom member 33 relative to each other may be suitably formed in them. For example, a groove for accommodating a lower edge 31*a* of the hollow member 31 may be formed in the bottom member 33.

Between the hollow member 31 and the bottom member 33, a plurality of clearances 21*h* (holes) communicating the inside and outside of the vessel 21 are formed. The clearances 21*h* are for letting the gas (for example air) in the vessel 21 escape to the outside of the vessel 21. Specifically, the plurality of clearances 21*h* are configured by formation of a plurality of cutouts 31*b* in the lower edge 31*a* of the hollow member 31. The plurality of cutouts 31*b* are formed in for example the same shapes and sizes as each other and are equally arranged along the edge 31*a* (circumference). The shapes of the cutouts 31*b* may be suitably set. In the present embodiment, a case where they are slit-shaped long, in the direction along the edge 31*a* (more specifically, elongated rectangles) will be illustrated.

The diameter (particularly the smallest diameter) of each clearance 21*h* is set to a size by which passage of part of the liquid phase contained in the metal material 101 from the inside of the vessel 21 to the outside is impossible. Note that, the "inability of passage" referred to here is sufficient so far as passage is not possible in a process from when the liquid-state metal material 101 is poured into the vessel 21 to when it exhibits a semi-solidified state. Inability of passage is not required under conditions such as a high pressure which is not given in that process.

For example, in the present embodiment, as will be explained later, the metal material 101 is rendered a semi-solidified state by just pouring it into the cooled vessel 21. Electromagnetic mixing or mechanical mixing is not carried out. Accordingly, the diameter of each clearance 21*h* may be a size by which the metal material 101 cannot pass under the pressure due to the weight of the metal material 101 or kinetic energy when pouring. Further, the metal material 101 partially becomes a solid phase immediately after pouring into the vessel 21 and its viscosity rises. It is sufficient that passage be impossible under the actual viscosity.

Such a diameter of a clearance 21*h* (width w of slit shown in FIG. 2B in the present embodiment) is for example 0.1 mm or less when the metal material 101 is an aluminum alloy. Further, the diameter of the clearance 21*h* may be made small within a range permitted by the machining accuracy. Note, the clearances 21*h* are formed for letting the gas in the vessel 21 escape, therefore they preferably have certain extents of sizes from the viewpoint of smoothly discharging the gas in the vessel 21 to the outside of the vessel 21.

The material configuring the bottom member 33 is comprised of a material having a higher thermal conductivity than that of the material configuring the hollow member 31. For example, in contrast to the hollow member 31 being configured by stainless steel, the bottom member 33 is configured by copper (pure copper).

Accordingly, compared with a case where the bottom member 33 is configured by the same material as that for the hollow member 31, the cooling speed of the metal material 101 at the bottom of the vessel 21 becomes faster. Further, from another viewpoint, although depending on the thicknesses etc. of the parts of the vessel 21 (see the second embodiment), the cooling speed of the metal material 101 at the bottom of the vessel 21 becomes faster than the cooling speed of the metal material 101 at the wall of the vessel 21.

Due to this, the metal material in the vessel 21 is given a temperature gradient so that the temperature becomes lower the further toward the side contacting the vessel 21 and becomes lower the further toward the lower bide. As a result, the solidification rate of the semi-solidified state metal material 101 (or highness of the solidification action) generated in the vessel 21 will satisfy the relationship of the vicinity of the bottom member 33>the vicinity of the inner surface of hollow member 31>center of the hollow member 31.

Accordingly, the (slurry of) the produced semi-solidified state metal material 101 has a higher solid phase rate (is solidified more) in its lower part than its upper part. Preferably, in the semi-solidified state metal material 101, a portion up to ⅕ (more preferably 1/10) of the height of the semi-solidified state metal material 101 from its bottom surface is solidified more than the upper part (for example the upper side portion from the center of the semi-solidified state metal material 101).

Operation of Production Apparatus

Next, the operation of the production apparatus 1 will be explained.

First, the control device 9 controls the heating device 13 based on the detection value of the first temperature sensor 15 and consequently maintains the temperature of the metal material 101 held in the furnace body 11 at a predetermined first temperature $T_1$. The first temperature $T_1$ is a temperature higher than the liquidus temperature of the metal material 101, so the metal material 101 is fully rendered the liquid-state.

Further, the control device 9 controls the cooling device 23 based on the detection value of the second temperature sensor 25 and consequently maintains the temperature of the vessel 21 at a predetermined second temperature $T_2$. The second temperature $T_2$ is a temperature lower than the liquidus temperature of the metal material 101. Note that, the hollow member 31 and the bottom member 33 are for example set to the same temperature as each other.

Further, the control device 9 controls the pouring device 5 to feed the metal material 101 held in the furnace body 11 to the vessel 21. Specifically, first, the conveying device 19 immerses the ladle 17 inclined by a predetermined angle in the liquid-state metal material 101 which is held in the furnace body 11 and then raises it (or inclines it after raising it) to thereby meter and dip out one shot's worth of the metal material 101. Further, the conveying device 19 moves the ladle 17 to above the vessel 21 and further inclines the ladle 17 to thereby pour the metal material 101 into the vessel 21. Note that, the cooling device 23 suspends cooling of the vessel 21 when the metal material 101 is being poured into the vessel 21. However, the cooling device 23 may continue cooling until thermal equilibrium which will be explained later is reached or until another suitable time.

The metal material 101 which is poured into the vessel 21 is rapidly cooled by contact with the vessel 21. Due to this, a large number of crystal nuclei are formed inside the metal material 101. The large number of crystal nuclei are agitated by the flow which occurs by pouring of the metal material 101 into the vessel 21 from a certain extent of height. Due to this, branches of the precipitated dendrite crystals are cut by a shearing force or cut by melting the same and the crystal nuclei further proliferate.

The vessel 21 suddenly rises in temperature by pouring of the metal material 101, so the function of the vessel 21 of cooling the metal material 101 drastically falls. As a result, after a large number of crystal nuclei are formed, the crystal growth rate suddenly falls, therefore the crystal does not grow in a dendrite state, but grows roundly.

Further, the metal material 101 and the vessel 21 are in a state of thermal equilibrium as a result of heat exchange. The temperature (third temperature $T_3$) of the metal material 101 and vessel 21 at this time is higher than the solidus temperature of the metal material 101, but lower than the liquidus temperature. Due to this, the metal material 101 is rendered a temperature at which the liquid phase and the solid phase can be mixed.

The third temperature $T_3$ and the solid phase rate have correlation. The third temperature $T_3$ is set so that a desired solid phase rate is obtained. Further, the first temperature $T_1$ and the second temperature $T_2$ are set by considering the densities, volumes, and specific heats of the metal material 101 and the vessel 21 and the latent heat of solidification of the metal material 101 so that the third temperature $T_3$ becomes a desired value.

Here, as already explained, the bottom member 33 has a higher thermal conductivity than that of the hollow member 31. Accordingly, near the bottom of the vessel 21, compared with the case where the thermal conductivity of the bottom member 33 is equivalent to the thermal conductivity of the hollow member 31, many crystal nuclei are apt to be formed and/or crystal is apt to grow. As a result, though the metal material 101 is agitated by the kinetic energy when it is poured, it becomes high in the solid phase rate near the bottom section.

When liquid-state metal material 101 is poured into the vessel 21, the gas (for example air) held in the vessel 21 is pushed out to the outside of the vessel 21. However, at the lower side of the vessel 21, there is no place for the gas to escape to. As a result, the gas is entrained in the metal material 101, so blowholes are liable to be formed. Here, in the present embodiment, clearances 21*h* are formed at the lower side of the vessel 21. Accordingly, the gas can flow out from the clearances 21*h*, so formation of blowholes is suppressed.

The clearances 21*h* are formed at the lower side of the vessel 21. On the other hand, as explained above, at the bottom of the vessel 21, it becomes easy to rapidly cool the metal material 101. Accordingly, by rapid cooling of the metal material 101 near the bottom to cause a rise of viscosity, the flow of the metal material 101 from the clearances 21*h* is suppressed. In other words, discharge of gas can be facilitated by forming the clearances 21*h* as large as possible.

When the metal material 101 and the vessel 21 reach thermal equilibrium or a certain extent of cooling time has passed after that, the semi-solidified state metal material 101 is taken out of the vessel 21. For example, the hollow member 31 and the bottom member 33 are separated, the opening at the lower side of the hollow member 31 is opened, and the semi-solidified state metal material 101 is taken out from the lower or upper part of the hollow member 31 by its own weight and/or a suitable extruding means (for example extruding device).

The semi-solidified state metal material 101 which is taken out of the hollow member 31 may be directly used to formation of a molded article by being fed to an injection sleeve of an injection device or may be a material (billet) of the semi-molten state metal by rapidly cooling and solidifying.

Here, as explained above, the semi-solidified state metal material 101 becomes high in the solid phase rate at the bottom. Therefore, in the process of taking out the semi-solidified state metal material 101 from the vessel 21 and feeding this to the injection sleeve etc., dripping of the liquid phase part from the bottom of the semi-solidified state metal material 101 is suppressed.

The vessel 21 from which the semi-solidified state metal material 101 is taken out is washed to remove the residual metal material 101. At this time, since the clearances 21*h* are formed by the gap between the hollow member 31 and the bottom member 33, by separating the hollow member 31 and the bottom member 33, washing of the clearances 21*h* is easily carried out.

As described above, in the present embodiment, the production apparatus 1 of the semi-solidified metal has a heating device 13 which heats the metal material 101, a vessel 21, a cooling device 23 which cools the vessel 21, and a pouring device 5 which pours the heated metal material 101 into the cooled vessel 21.

Further, the vessel 21 has the hollow member 31 which configures the wall of the vessel 21 and is opened at both of the upper and lower ends and into which the metal material 101 is poured from its upper opening and has the bottom member 33 which closes the lower opening of the hollow member 31 and configures the bottom of the vessel 21. Further, the cooling speed of the metal material 101 by the bottom member 33 is faster than the cooling speed of the metal material 101 by the hollow member 31.

Accordingly, as already explained, it is easy to make the solid phase rate at the bottom of the semi-solidified state metal material 101 high, therefore the liability of the liquid phase part to drip from the bottom portion is reduced. As a result, for example, the necessity of forming an opening at the center of the bottom member 33 and discharging a portion of the liquid phase part contained in the semi-solidified state metal material 101 can be eliminated. By not discharging a portion of the liquid phase part, the casting weight can be correctly controlled. Further, formation of blowholes by the gas entering into the cavities from which the liquid phase part was discharged is suppressed. As a result, the quality of the molded article is improved.

From another viewpoint, in the present embodiment, the production apparatus 1 of the semi-solidified metal has a heating device 13 which heats the metal material 101, a vessel 21, a cooling device 23 which cools the vessel 21, and a pouring device 5 which pours the heated metal material 101 into the cooled vessel 21. Holes (clearances 21*h*) having diameters by which a portion of the liquid phase contained in the metal material 101 cannot flow out to the outside of the vessel 21 and the gas in the vessel 21 can flow out to the outside of the vessel 21 are formed at the lower side of the vessel 21.

Accordingly, as already explained, at the lower side of the vessel, the gas is kept from losing a place to escape to, therefore the content of the gas of the semi-solidified metal is reduced. Due to that, formation of blowholes in the molded article formed from the semi-solidified metal is suppressed, so the quality of the molded article is improved.

Second Embodiment

The second embodiment differs from the first embodiment only in the material and dimensions of the vessel, more specifically, only the material and dimensions of the bottom member. Accordingly, the same notations as those in the first embodiment will be used, and FIG. 1 and FIG. 2 will be referred to. Further, the points which are not particularly referred to are the same as the first embodiment.

In the second embodiment, the material configuring the bottom member 33 is the same as the material configuring the hollow member 31, and the thickness of the bottom member 33 becomes greater than the thickness of the hollow member 31. For example, the thickness of the bottom member 33 is at least 1.5 times the thickness of the hollow member 31. More preferably, the thickness of the bottom member 33 is at least 2 to 3 times the thickness of the hollow member 31.

Note that, when the thicknesses of the hollow member 31 and the bottom member 33 are not constant, for example, by comparing the maximum thickness of the hollow member 31 and the minimum thickness of the bottom member 33, it may be judged whether the thickness of the bottom member 33 is greater than the thickness of the hollow member 31. Further, for example, it may be judged whether the thickness of the bottom member 33 is not less than 1.5 times the thickness of the hollow member 31 by comparing the average of thickness of the hollow member 31 and the average of thickness of the bottom member 33.

However, in the above judgment, it is appropriate to not consider the part in the vessel 21 which is made thick or thin from a viewpoint other than the cooling of the metal material 101. For example, even when a groove in which the lower edge of the hollow member 31 fits is formed on the upper surface of the bottom member 33 and the bottom member 33 is made thin, proper judgment as described above is carried out by excluding this part.

By such formation so that the thickness of the bottom member 33 is made greater than the thickness of the hollow member 31 as described above, compared with the case where the thickness of the bottom member 33 is made the same as the thickness of the hollow member 31, the cooling speed of the metal material 101 at the bottom of the vessel 21 becomes faster. Further, from another viewpoint, although depending on the materials of parts of the vessel 21 as well (see the first embodiment), the cooling speed of the metal material 101 at the bottom of the vessel 21 becomes faster than the cooling speed of the metal material 101 at the wall of the vessel 21. Further, from another viewpoint, the bottom of the vessel 21 has a higher cooling power on the metal material 101 than the wall of the vessel 21. Further, the cooling speed of the metal material 101 by the bottom member 33 is faster than the cooling speed of the metal material 101 by the hollow member 31.

Accordingly, when the metal material 101 is poured into the vessel 21, a larger amount of crystal nuclei are formed and/or crystal grows more in the metal material 101 near the bottom of the vessel 21 than the metal material 101 near the wall of the vessel 21. As a result, although the metal material 101 is being agitated by the kinetic energy when it is poured, the solid phase rate becomes higher in the vicinity of the bottom than the vicinity of the wall.

That is, in the same way as the first embodiment, it is easy to make the solid phase rate at the bottom of the semi-solidified state metal material 101 higher, and the liability of dripping of the liquid phase part from the bottom is reduced. As a result, in the same way as the first embodiment, the necessity of discharging a portion of the liquid phase part is eliminated and in turn the control of the pouring weight can be correctly controlled. Also, the formation of blowholes due to entry of gas into cavities from which the liquid phase part was discharged is suppressed. As a result, the quality of the molded article is improved.

Note that, in the above explanation, the material of the hollow member 31 and the material of the bottom member 33 were the same material, but they may differ from each other as well.

For example, in the same way as the first embodiment, the materials of the members may be selected so that the thermal conductivity of the material of the bottom member 33 becomes higher than the thermal conductivity of the material of the hollow member 31. In this case, the effect of the cooling speed by the bottom member 33 becoming faster than the cooling speed by the hollow member 31 increases.

Conversely, the materials of the members may be selected so that the thermal conductivity of the material of the bottom member 33 becomes lower than the thermal conductivity of the material of the hollow member 31. Note, in this case, it is necessary to make the thickness of the bottom member 33 sufficiently thick relative to the thickness of the hollow member 31 so that the cooling speed by the bottom member 33 becomes faster than the cooling speed by the hollow member 31.

Third Embodiment

The third embodiment differs from the first embodiment only in the temperatures of the bottom member and hollow member immediately before pouring the liquid-state metal material. Accordingly, the same notations as those in the first embodiment will be used, and FIG. 1 and FIG. 2 will be referred to. Further, the points which are not particularly referred to are the same as in the first embodiment.

In the third embodiment, the bottom member 33 and the hollow member 31 are cooled to temperatures which are different from each other by the cooling device 23 immediately before the liquid-state metal material 101 is poured. Specifically, the hollow member 31 is cooled to a fourth temperature $T_4$ which is lower than the liquidus temperature of the metal material 101, and the bottom member 33 is cooled to a fifth temperature $T_5$ which is further lower than the fourth temperature $T_4$.

Accordingly, for example, in the case where the thicknesses and materials of the bottom member 33 and the hollow member 31 are the same, the cooling speed of the metal material 101 by the bottom member 33 becomes faster than the cooling speed by the hollow member 31.

In the third embodiment as well, the methods of making the cooling speed by the bottom member 33 faster than the cooling speed by the hollow member 31 as explained in the first and second embodiments may be employed. That is, the material configuring the bottom member 33 may be made one having a higher thermal conductivity than the material configuring the hollow member 31 or the thickness of the bottom member 33 may be made greater than the thickness of the hollow member 31.

Further, in the third embodiment, the material configuring the bottom member 33 may be made one having a lower thermal conductivity than the material configuring the hollow member 31 and/or the thickness of the bottom member 33 may be made thinner than the thickness of the hollow member 31. Even in such a case, if the fifth temperature $T_5$ is set to a temperature which is sufficiently low with respect to the fourth temperature $T_4$, the cooling speed by the bottom member 33 may be made higher than the cooling speed by the hollow member 31.

Note that, in the third embodiment, preferably a temperature sensor and a cooling device are provided in each of the hollow member 31 and the bottom member 33, and feedback controls of the temperatures are carried out independently from each other.

As described above, in the third embodiment as well, in the same way as the first embodiment, the cooling speed of the metal material 101 by the bottom member 33 is faster than the cooling speed of the metal material 101 by the hollow member 31.

Accordingly, in the same way as the first embodiment, it is easy to make the solid phase rate at the bottom of the semi-solidified state metal material 101 high, therefore the liability of the liquid phase part dripping from the bottom portion is reduced. As a result, in the same way as the first embodiment, the necessity of discharging a portion of the liquid phase part is eliminated and consequently the casting weight can be correctly controlled. Also, the formation of blowholes by gas entering into the cavities from which the liquid phase part was discharged is suppressed. As a result, the quality of the molded article is improved.

The present invention is not limited to the above embodiments and may be executed in various ways.

The overall configuration of the production apparatus is not limited to the configuration of dipping out a liquid-state metal material from a holding furnace by a ladle and pouring this into the vessel. For example, a crucible which melts one shot's worth of the metal material may be used in place of the holding furnace and ladle, and the metal material poured into the vessel by the crucible as well. Further, for example, the liquid-state metal material may be poured from the holding furnace into the vessel through a suitable channel as well.

In the production of the semi-solidified metal, all processes do not have to be automatically carried out by the production apparatus. For example, at least one of the control of the heating device, the control of the cooling device, and the control of the pouring device may be carried out by a worker as well. Further, for example, at least one of the heating, cooling, and pouring may be realized not according to facilities which are enough to be called "apparatuses".

In the present embodiment, the semi-solidified metal was obtained by just pouring the liquid-state metal material into the vessel from a certain extent of height. However, suitable stirring etc. may be carried out as well. Further, in the present embodiment, no portion of the liquid phase part was discharged from the semi-solidified metal, but part may be discharged. Even in this case, by raising of the solid phase rate at the bottom, the effect of suppression of the discharge compared with the conventional case is exhibited.

The hollow member and the bottom member are not limited to ones which can be attached to or detached from each other and may be connected to each other so that they cannot be separated from each other. Holes (clearances 21*h*) need not be formed in the vessel either. The holes are not limited to ones formed by gaps between the hollow member and the bottom member and may be holes formed in the hollow member itself or the bottom itself.

In the case where the provision of holes (clearances 21*h*) in the vessel is made a characteristic feature, the vessel is not limited to one configured by the hollow member and bottom member and may be integrally molded as a whole. Further, the holes (clearances 21*h*) are not limited to ones formed by gaps between the hollow member and the bottom member and may be holes formed in the integrally formed vessel or holes which are formed in the hollow member itself or the bottom member itself.

The clearances between the hollow member and the bottom member are not limited to ones configured by formation of cutouts at the edge of the hollow member. For example, the clearances may be configured by formation of parts which are not closed at portions of the opening of the hollow member by provision of cutouts at the edge of the bottom member as well. Further, the hollow member and the bottom member may be held so that the hollow member is made to float from the bottom member or the outer shape of the bottom member may be made smaller than the opening of the hollow member to suitably hold the hollow member and the bottom member.

The cooling device may have a difference between the coolability of the hollow member and the coolability of the bottom member. For example, the channel of the coolant may be provided so that the channel length per unit area of the bottom member becomes larger than the channel length per unit area of the hollow member. Further, the cooling device may be able to separately control the temperature of the hollow member and the temperature of the bottom member as well. For example, channels of coolant, heat exchangers, pumps, etc. may be provided separately for the hollow member and the bottom member, and temperature sensors may be separately provided for the hollow member and the bottom member. Note that, in such case, even when the thermal conductivity of the bottom member is not higher than the thermal conductivity of the hollow member, it is possible to make the metal material and the vessel reach thermal equilibrium in a state where the cooling speed of the metal material contacting the bottom member faster than the cooling speed of the metal material contacting the hollow member and thereby obtain the same effects as those by the above embodiments.

In the present application, the lower, side of the vessel means the lower side when the vessel is divided into the two sides of the upper side and lower side unless otherwise indicated. The holes of the vessel are preferably provided within a range up to ⅕ of the height of the vessel from the bottom section of the vessel, more preferably, are provided within a range up to 1/10.

REFERENCE SIGNS LIST

Priorities are claimed on the following applications, the contents of which are incorporated herein by reference.

Japanese Patent application No. 2012-132824 filed on Jun. 12, 2012

Japanese Patent application No. 2012-132825 filed on Jun. 12, 2012

Japanese Patent application No. 2013-91307 filed on Apr. 24, 2013

1 . . . production apparatus, 5 . . . pouring device, 9 . . . control device, 13 . . . heating device, 21 . . . vessel, **21*h* . . . clearance (hole), 23 . . . cooling device, 31 . . . hollow member, 33 . . . bottom member, and 101** . . . metal material.

The invention claimed is:

1. An apparatus for producing a semi-solidified metal, comprising:

a heating device configured to heat a metal material;

a vessel;

a cooling device configured to cool the vessel; and a pouring device configured to pour the heated metal material into the cooled vessel; wherein a hole is formed at a lower side of the vessel, the hole having a diameter by which the metal material in liquid phase cannot flow to the outside of the vessel and gas in the vessel can flow to the outside of the vessel.

2. The apparatus for producing a semi-solidified metal as set forth in claim 1, wherein:

the vessel comprises:

a hollow member defining a wall of the vessel and opened at upper and lower ends and into which the metal material is poured from the upper opening; and a bottom member which closes the lower opening of the hollow member and defines the bottom of the vessel; and a thickness of the bottom member is greater than a thickness of the hollow member so that the cooling speed of the metal material by the bottom member is faster than the cooling speed of the metal material by the hollow member.

3. The apparatus for producing a semi-solidified metal as set forth in claim 2, wherein a material of the bottom member is the same as a material of the hollow member.

4. The apparatus for producing a semi-solidified metal as set forth in claim 1, wherein:

the vessel comprises:

a hollow member defining a wall of the vessel and opened at upper and lower ends and into which the metal material is poured from the upper opening; and a bottom member which closes the lower opening of the hollow member and defines the bottom of the vessel; and a material of the bottom member has a higher thermal conductivity than a material of the hollow member so that the cooling speed of the metal material by the bottom member is faster than the cooling speed of the metal material by the hollow member.

5. The apparatus for producing a semi-solidified metal as set forth in claim 1, wherein:

the vessel comprises:

a hollow member defining a wall of the vessel and opened at upper and lower ends and into which the metal material is poured from the upper opening; and a bottom member which closes the lower opening of the hollow member and defines the bottom of the vessel; and the cooling device cools the bottom member to a lower temperature than a temperature of the hollow member so that the cooling speed of the metal material by the bottom member is faster than the cooling speed of the metal material by the hollow member.

6. The apparatus for producing a semi-solidified metal as set forth in claim 2, wherein:

the hollow member and the bottom member are configured to be separated from each other, and the hole is formed by a clearance between the hollow member and the bottom member.

7. The apparatus for producing a semi-solidified metal as set forth in claim 6, wherein:

an edge defining the lower opening of the hollow member comes into contact with the upper surface of the bottom member, and a cutout forming the clearance between the hollow member and the bottom member is defined by the edge.

8. The apparatus for producing a semi-solidified metal as set forth in claim 3, wherein the cooling device is configured to set a temperature of the bottom member and a temperature of the hollow member to the same temperature.

9. The apparatus for producing a semi-solidified metal as set forth in claim 3, wherein the cooling device is configured to cool the bottom member to a lower temperature than a temperature of the hollow member.

10. The apparatus for producing a semi-solidified metal as set forth in claim 2, wherein a material of the bottom member has a higher thermal conductivity than a material of the hollow member.

11. The apparatus for producing a semi-solidified metal as set forth in claim 10, wherein the cooling device is configured to set a temperature of the bottom member and a temperature of the hollow member to the same temperature.

12. The apparatus for producing a semi-solidified metal as set forth in claim 10, wherein the cooling device is configured to cool the bottom member to a lower temperature than a temperature of the hollow member.

13. The apparatus for producing a semi-solidified metal as set forth in claim 4, wherein the cooling device is configured to set a temperature of the bottom member and a temperature of the hollow member to the same temperature.

14. The apparatus for producing a semi-solidified metal as set forth in claim 4, wherein the cooling device is configured to cool the bottom member to a lower temperature than a temperature of the hollow member.

15. The apparatus for producing a semi-solidified metal as set forth in claim 1, wherein the lower side comprises a lower end in which the hole is formed.

16. The apparatus for producing a semi-solidified metal as set forth in claim 4, wherein:

the hollow member and the bottom member are configured to be separated from each other, and the hole is formed by a clearance between the hollow member and the bottom member.

17. The apparatus for producing a semi-solidified metal as set forth in claim 16, wherein:

an edge defining the lower opening of the hollow member comes into contact with the upper surface of the bottom member, and a cutout forming the clearance between the hollow member and the bottom member is defined by the edge.

18. The apparatus for producing a semi-solidified metal as set forth in claim 5, wherein:

the hollow member and the bottom member are configured to be separated from each other, and the hole is formed by a clearance between the hollow member and the bottom member.

19. The apparatus for producing a semi-solidified metal as set forth in claim 18, wherein:

an edge defining the lower opening of the hollow member comes into contact with the upper surface of the bottom member, and a cutout forming the clearance between the hollow member and the bottom member is defined by the edge.

* * * * *